US012298099B1

(12) United States Patent
Landi, Jr. et al.

(10) Patent No.: US 12,298,099 B1
(45) Date of Patent: May 13, 2025

(54) VARIABLE SAFETY OUTPUT CONTROL SYSTEM FOR TOY PROJECTOR

(71) Applicant: NSI INTERNATIONAL, INC., New York, NY (US)

(72) Inventors: Frank J. Landi, Jr., New York, NY (US); Adam Gelder, Oak Lawn, IL (US)

(73) Assignee: NSI INTERNATIONAL, INC., New York, NY (US)

( * ) Notice: Subject to any disclaimer, the term of this patent is extended or adjusted under 35 U.S.C. 154(b) by 0 days.

(21) Appl. No.: 18/630,292

(22) Filed: Apr. 9, 2024

Related U.S. Application Data

(60) Provisional application No. 63/549,138, filed on Feb. 2, 2024.

(51) Int. Cl.

| | |
|---|---|
| ***F41B 11/723*** | (2013.01) |
| ***F41B 11/55*** | (2013.01) |
| ***F41B 11/681*** | (2013.01) |
| ***F41B 11/89*** | (2013.01) |

(52) U.S. Cl.
CPC ..... *F41B 11/89* (2013.01); *F41B 11/55* (2013.01); *F41B 11/681* (2013.01); *F41B 11/723* (2013.01)

(58) Field of Classification Search
CPC ..... F41B 11/723; F41B 11/64; F41B 11/89; F41B 11/54; F41B 11/642; F41B 7/08; F41B 7/003
See application file for complete search history.

(56) References Cited

U.S. PATENT DOCUMENTS

| | | | | |
|---|---|---|---|---|
| 9,823,040 | B1 * | 11/2017 | Hu | F41B 11/70 |
| 2016/0084598 | A1 * | 3/2016 | Gomez | F41A 5/28 89/193 |
| 2019/0293383 | A1 * | 9/2019 | Skilling | F41B 11/723 |
| 2021/0299357 | A1 * | 9/2021 | Kalmanson | A61M 5/2053 |

* cited by examiner

*Primary Examiner* — Michael D David
(74) *Attorney, Agent, or Firm* — Andrew F. Young, Esq.; NOLTE LACKENBACH SIEGEL

(57) ABSTRACT

A variable safety output control system for a pneumatic toy dart projector (toy dart gun) has an adjustable output power (pressure) control system for power adjustment. A variable safety output control system has a manual dual-sided pressure adjustment safety mechanism that controllably limits a pneumatic pump power stroke and the resulting pneumatic pressure for dart release. A guiding and release mechanism for the adjustment safety mechanism operates with spaced-apart pressure-portions and high-pressure requirements allowing an adult-strength-level adjustment while minimizing juvenile-strength-level adjustment for improved safety.

3 Claims, 12 Drawing Sheets

VARIABLE SAFETY OUTPUT CONTROL SYSTEM FOR TOY PROJECTOR

CROSS REFERENCE TO RELATED APPLICATIONS

This application relates to, and claims priority from, U.S. Prov. Ser. 63/549,138 filed Feb. 2, 2024, the entire contents of which are fully incorporated herein by reference.

FIGURE SELECTED FOR PUBLICATION

FIG. 4

BACKGROUND OF THE INVENTION

Field of the Invention

This invention relates to a pneumatic toy dart projector (toy dart gun) with a variable safety output control system for power adjustment. More fully, the present invention relates to a variable safety output control system for a toy dart projector with an adjustable manual safety mechanism operating with a dual-sided pressure manipulation and multi-stage positions that control a pump power stroke.

Description of the Related Art

The related art includes various toy dart-guns that operate with compressed gas (pneumatic) to project a toy-dart from a chamber and outward through a barrel. Such related art devices may involve a manual pump or a stored compressed gas (canister) system.

Such conventional toy systems often suffer from at least two specific faults among many others in the conventional toy arts. These include (i) the lack of an effective safety (on/off) mechanism and the lack of (ii) an ability to vary a release-power pressure for projection controlled by an adult-strength user to effectuate juvenile-strength user safety.

ASPECTS AND SUMMARY OF THE INVENTION

One aspect and object of the present invention is to overcome at least one of the detriments in the conventional arts.

According to one aspect or object of the present invention there is provided a variable safety output control system for a pneumatic toy dart projector (toy dart gun) has an adjustable output power (pressure) control system for power adjustment. A variable safety output control system has a manual dual-sided pressure adjustment safety mechanism that controllably limits a pneumatic pump power stroke and the resulting pneumatic pressure for dart release.

According to another aspect or object of the present invention, a guiding and release mechanism for the adjustment safety mechanism operates with spaced-apart pressure-portions and high-pressure requirements allowing an adult-strength-level adjustment while minimizing juvenile-strength-level adjustment for improved safety.

According to another alternative aspect and object of the present invention, there is provided a variable safety output control system (50), for use in a pneumatic toy projector (1), comprising: a pneumatic pressure generation, storage, and release system (60); a dart magazine and transfer system (70) operative to store a plurality of darts for sequential dart release and to position respective ones of said darts in a release chamber prior to projection of said dart from said release chamber through a barrel and outwardly from said pneumatic toy projector; a trigger mechanism (80) operative to engage said pneumatic pressure generation, storage, and release system and release said respective ones of said darts upon an individual trigger mechanism cycle.

According to another alternative aspect and object of the present invention, there is provided a variable safety output control system (50), for use in a pneumatic toy projector (1), further comprising: a manual dual-sided pressure adjustment safety mechanism (40) engaging with said pneumatic pressure generation, storage and release system to manually adjust a pneumatic power adjustment during a use; a guiding and release mechanism (41) in said manual dual-sided pressure adjustment safety mechanism; said guiding and release mechanism operating to guide a pressure generation member (61) during said pneumatic pressure generation; said guiding and release mechanism having dual pairs of key-blocks (42, 42), operating to adjustably restrain a pneumatic pump power stroke during said use and to restrain said pressure generation member (61).

According to another alternative aspect and object of the present invention, there is provided a variable safety output control system (50), for use in a pneumatic toy projector (1), further comprising: two opposed spaced-apart pressure portions (40A, 40A) in said dual-sided pressure adjustment safety mechanism (40); a spring mechanism (43) urging said two opposed spaced-apart pressure portions (40A, 40A) in opposing directions at an adult-strength-pressure level that is substantially greater than a juvenile-strength-level; said dual pairs of key-blocks (42, 42) on said respective spaced-apart pressure portions (40A, 40A) that operate in conjunction with a motion of said respective spaced-apart pressure portions to manually engage and release one of at least three power safety adjustment stages (51, 51, 51) and fix a length of said pneumatic pump stroke during said use and thereby restrain said pressure generation member (61) accordingly operate said pneumatic toy projector (1) with a variable power via said variable safety output control system (50).

According to another alternative aspect and object of the present invention, there is provided a variable safety output control system (50), for use in a pneumatic toy projector (1), further comprising: a pump handle (52) in said pneumatic pressure generation, storage and release system (60); said pump handle (52) operatively directing said pneumatic pump stroke during said use to a limit controlled by said dual-sided pressure adjustment safety mechanism (40).

According to another alternative aspect and object of the present invention, there is provided a variable safety output control system (50), for use in a pneumatic toy projector as shown and disclosed herein.

The above and other aspects, features and advantages of the present invention will become apparent from the following description read in conjunction with the accompanying drawings, in which like reference numerals designate the same elements.

DETAILED DESCRIPTION OF THE PREFERRED EMBODIMENTS

Figure 1:
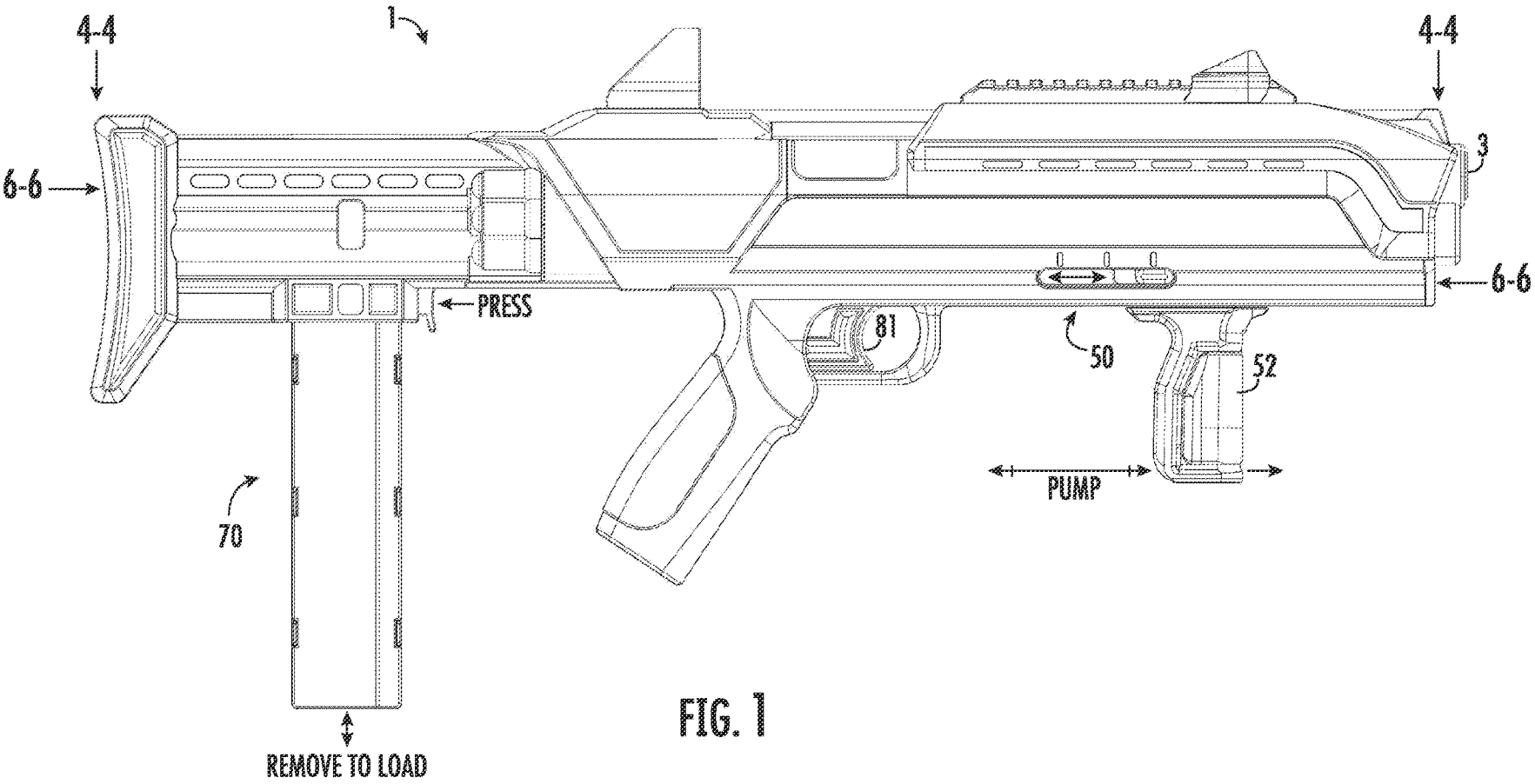
FIG. 1 is a side view of a pneumatic toy projector with a variable safety output control system according to one aspect of the present invention.
Figure 2:
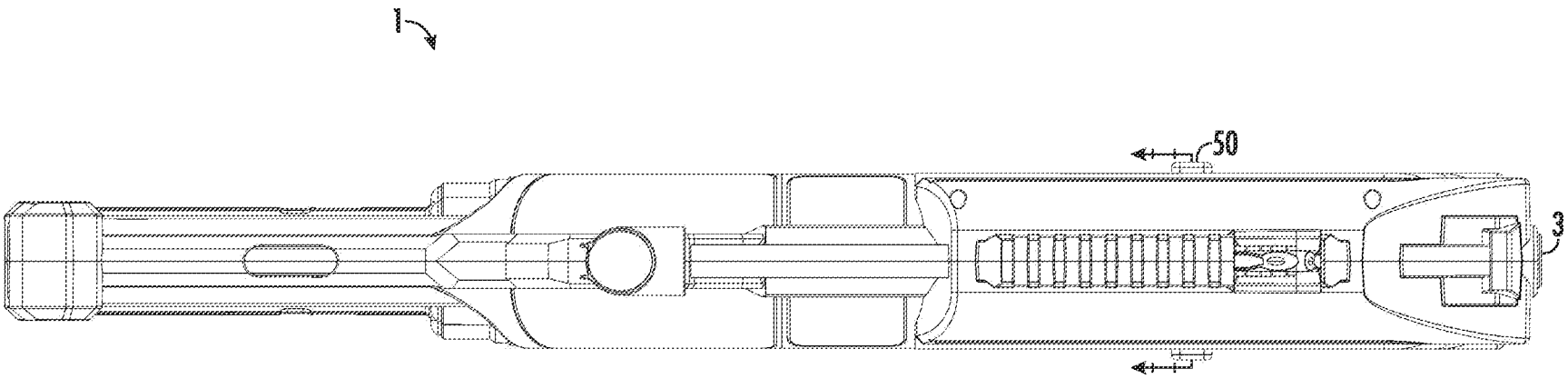
FIG. 2 is a top plan view of FIG. 1.
Figure 3:
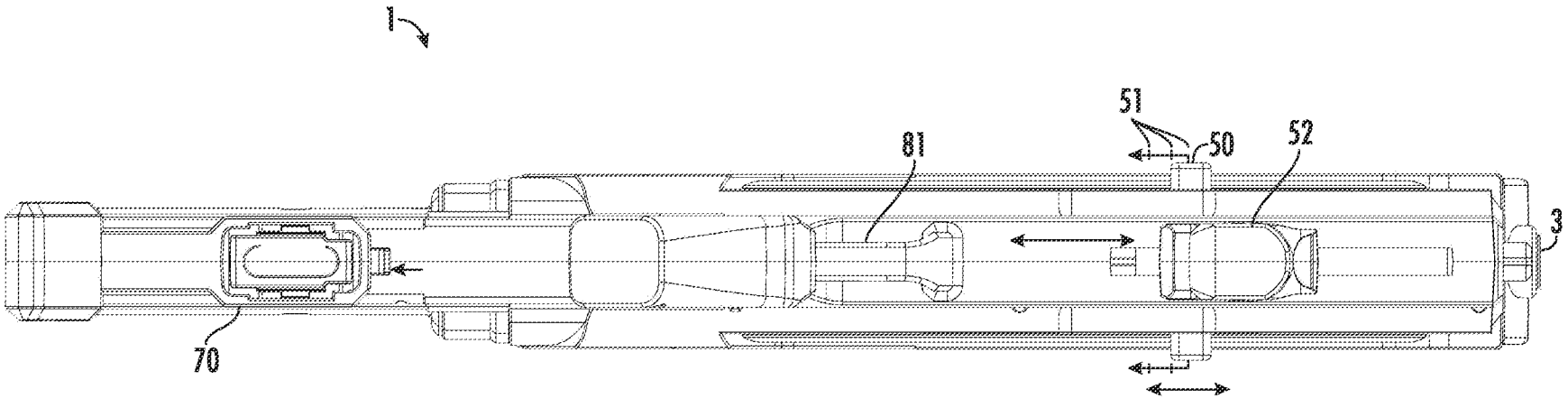
FIG. 3 is a bottom plan view of FIG. 1 noting the two opposed spaced apart pressure portions and pump handle motion.
Figure 4:
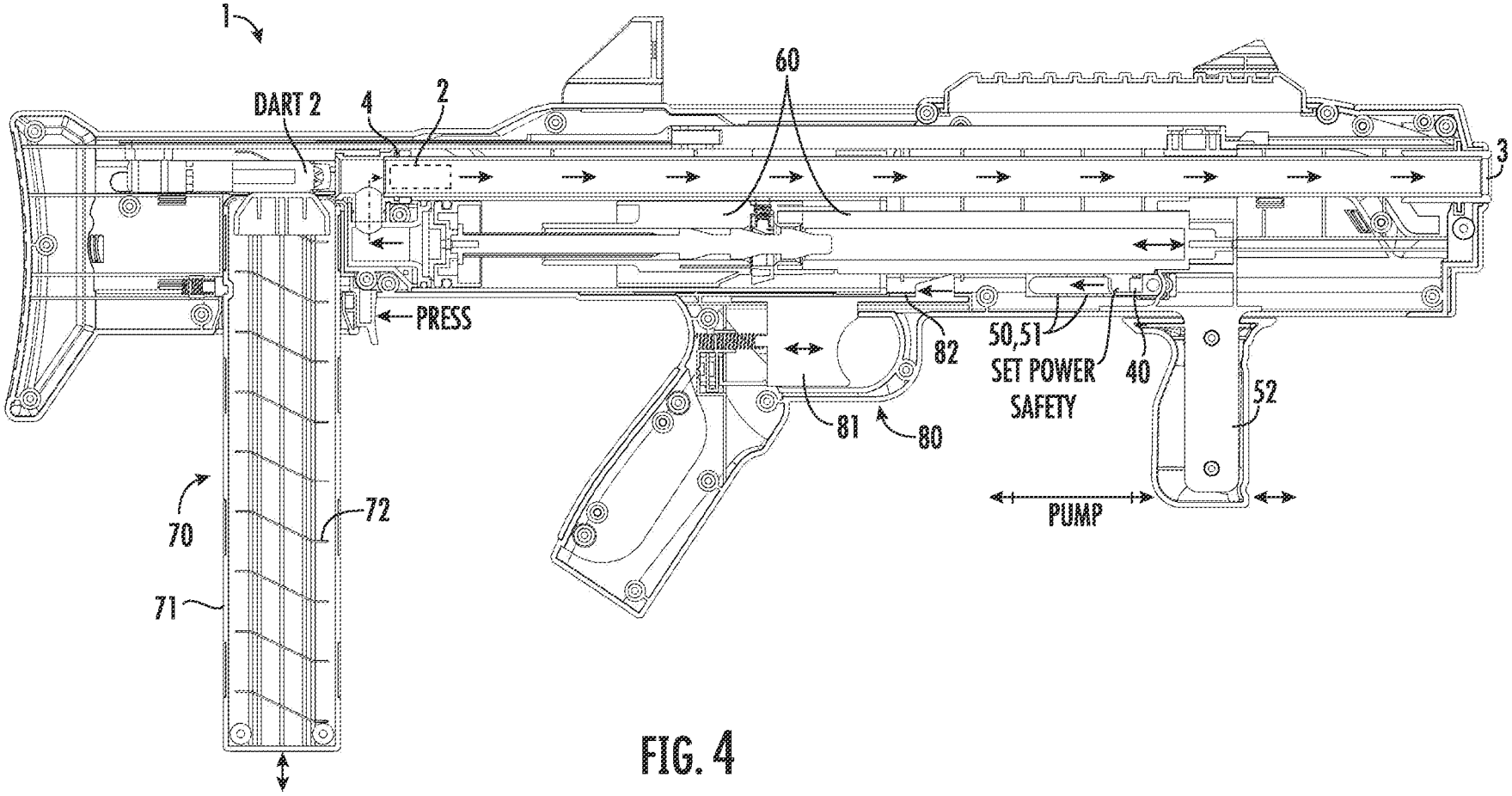
FIG. 4 is a section view along Section 4-4 in FIG. 1 noting the internal components.
Figure 5:
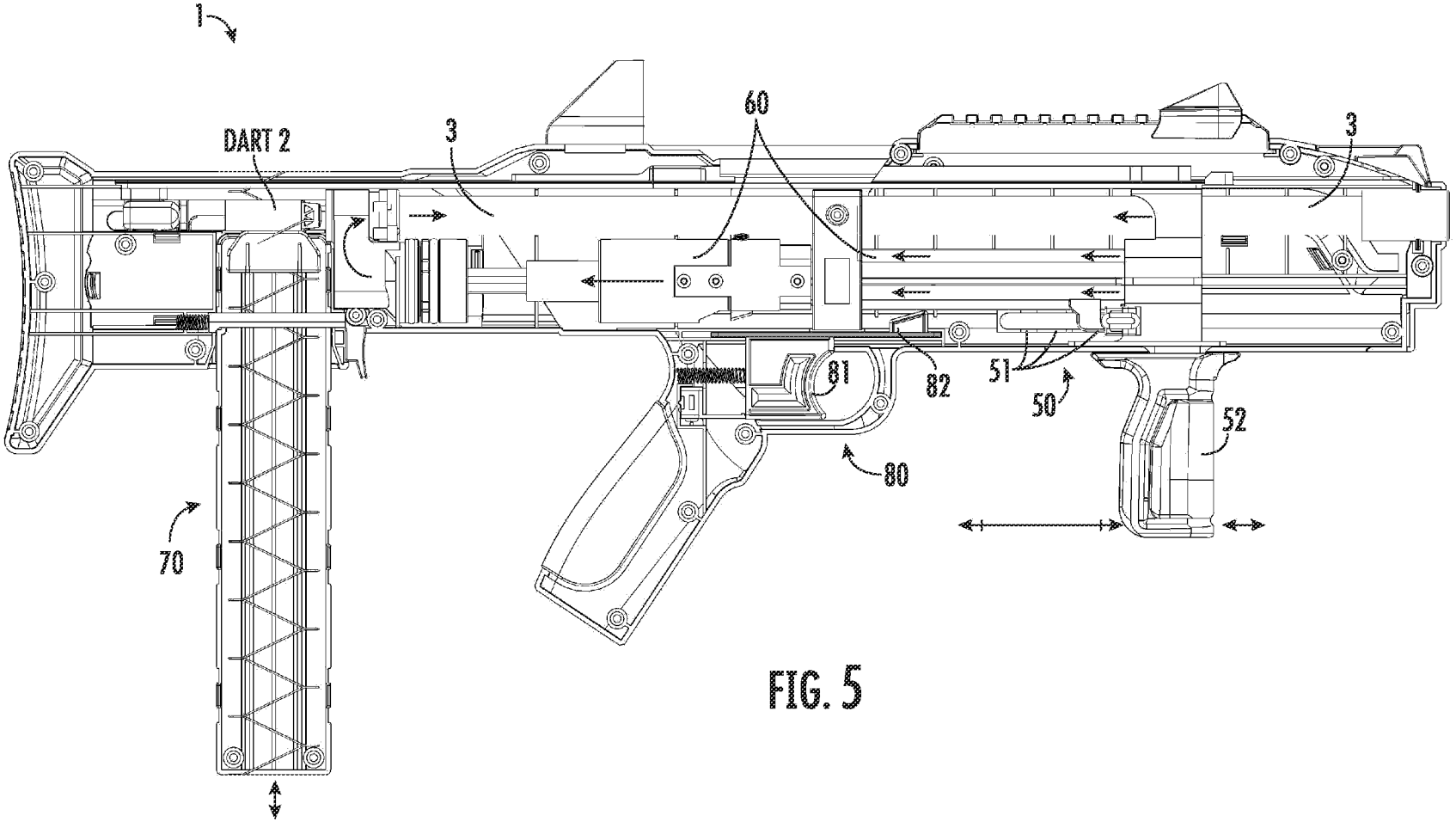
FIG. 5 is a partial sectional view related to FIG. 4 with side elements removed to illustrate operation elements.
Figure 6:
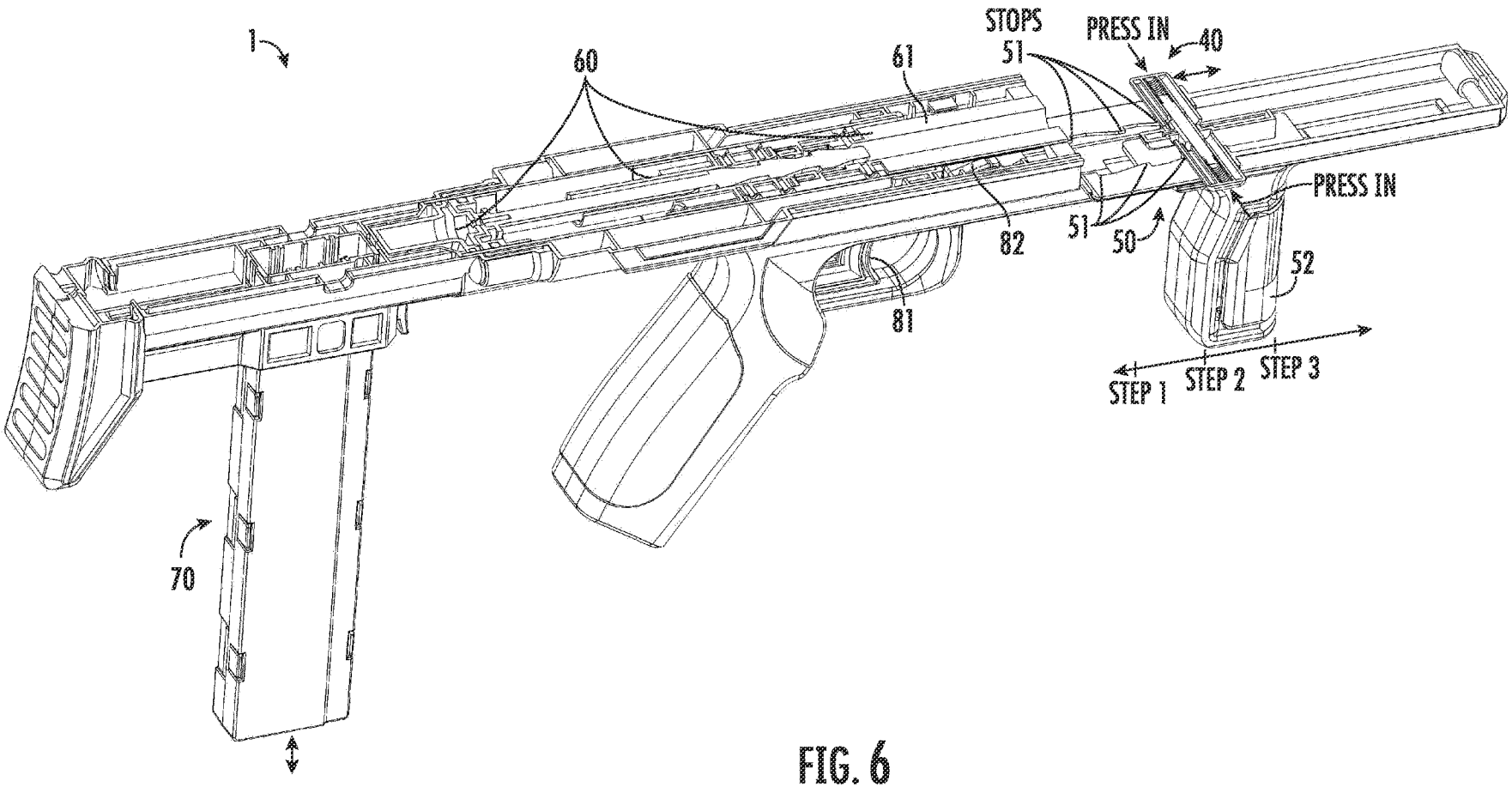
FIG. 6 is a section view along Section 6-6 in FIG. 1 noting the two opposed spaced apart pressure portions in the manual dual-sided pressure adjustment safety mechanism.
Figure 7:
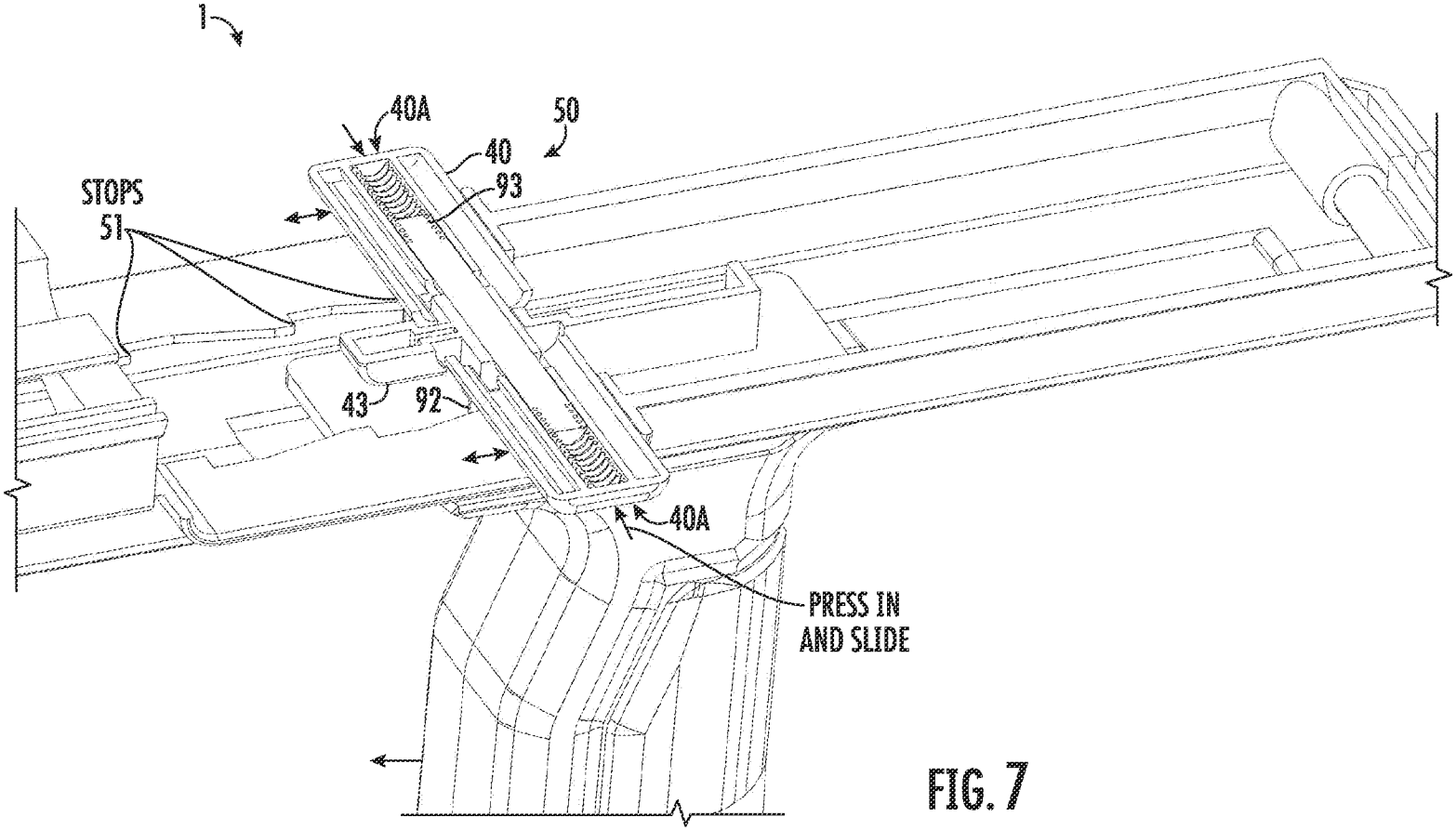
FIG. 7 is a partial close up view of FIG. 6 illustrating the power safety adjustment stages and related stops.
Figure 8:
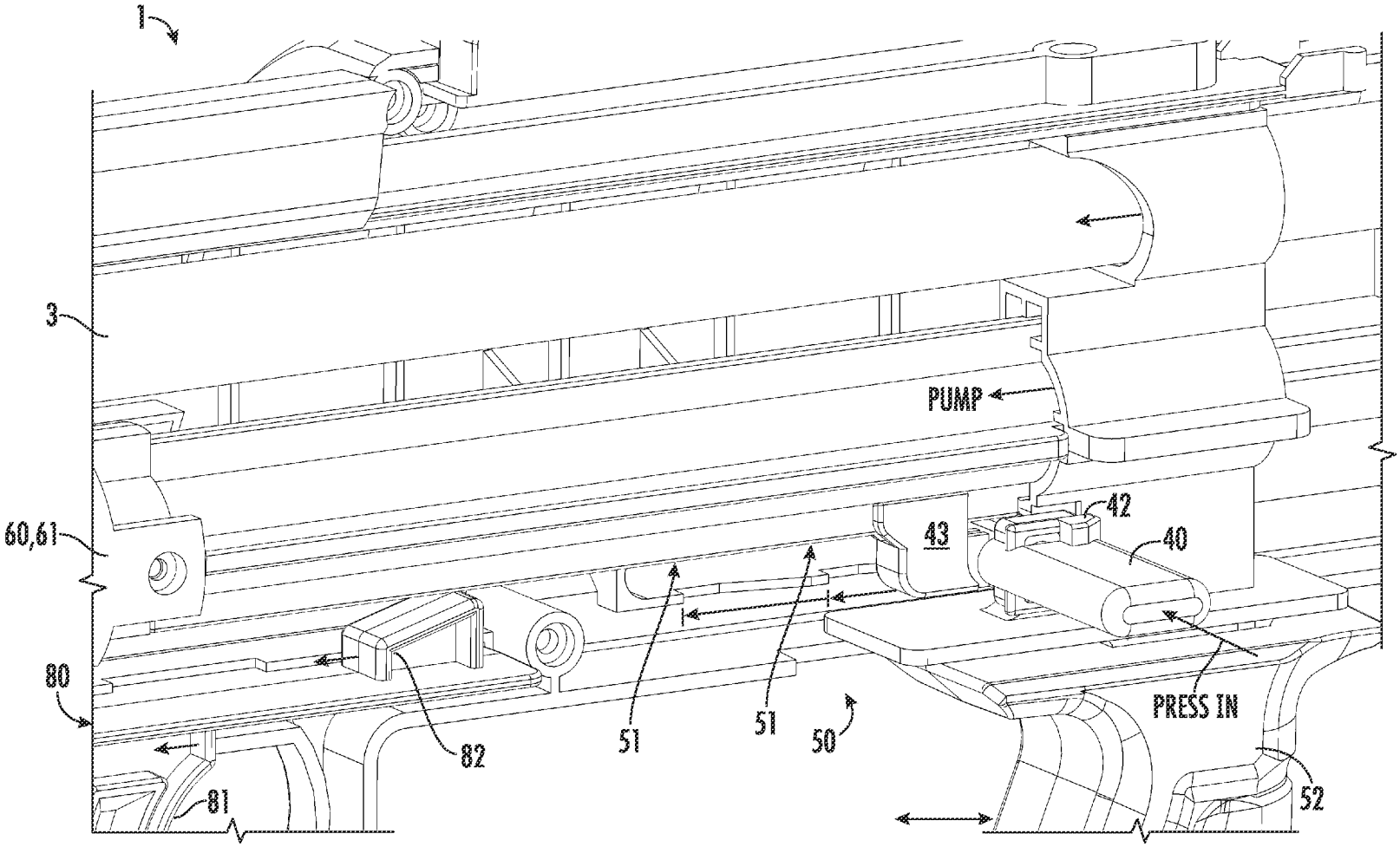
FIG. 8 is a partial close up perspective view related to FIG. 5 noting internal components of the variable safety output control system.

Reference will now be made in detail to embodiments of the invention. Wherever possible, same or similar reference numerals are used in the drawings and the description to refer to the same or like parts or steps. The drawings are in simplified form and are not to precise scale. The word 'couple' and similar terms do not necessarily denote direct and immediate connections, but also include connections through intermediate elements or devices. For purposes of convenience and clarity only, directional (up/down, etc.) or motional (forward/back, etc.) terms may be used with respect to the drawings. These and similar directional terms should not be construed to limit the scope in any manner. It will also be understood that other embodiments may be utilized without departing from the scope of the present invention, and that the detailed description is not to be taken in a limiting sense, and that elements may be differently positioned, or otherwise noted as in the appended claims without requirements of the written description being required thereto.

Referring now to FIGS. 1 to 12 a pneumatic toy projection 1 is presented having pump handle 52 and a variable safety output control system 50 with power safety adjustment stages 51, 51, 51.

An integrated pneumatic generation, storage, and release system 60, comprises multiple interoperative components, and is provided with a pressure generation member 61 that allows a pump-motion pressure building that is limited by a pressure-stroke safety controlled by the variable safety output control system 50 that provides a pressurized air flow system (see arrows) to project a dart 2 through a barrel 3 via a dart magazine and transfer system 70. Dart magazine and transfer system 70 provides for a storage of a plurality of darts 2 in a magazine 71 with an internal spring 72 and positioning of dart 2 within a dart chamber 4 aligned with barrel 3 during a use.

A trigger mechanism 80 includes a trigger 81, and a trigger motion transfer member 82 for operating the pneumatic generation, storage, and release system 60 during a use to expel a dart 2 from barrel 3.

The variable safety output control system 50 further includes a manual dual-sided pressure adjustment safety mechanism 40 having two opposed spaced apart pressure portions 40A, 40A urged apart by a spring mechanism 43 having a spring tension at an pre-determined adult-power level that is substantially greater than a pre-determined juvenile-power level; thereby permitting compaction of spring mechanism 43 only by a user having such adult-power levels in their hands thereby restricting juvenile-power level users to an adult predetermined level.

The manual dual-sided pressure adjustment safety mechanism 40 includes a guiding and release mechanism 41 allowing an interfering fit with respective power safety adjustment stages 51, 51, 51 in the variable safety output control system 50.

Figure 9:
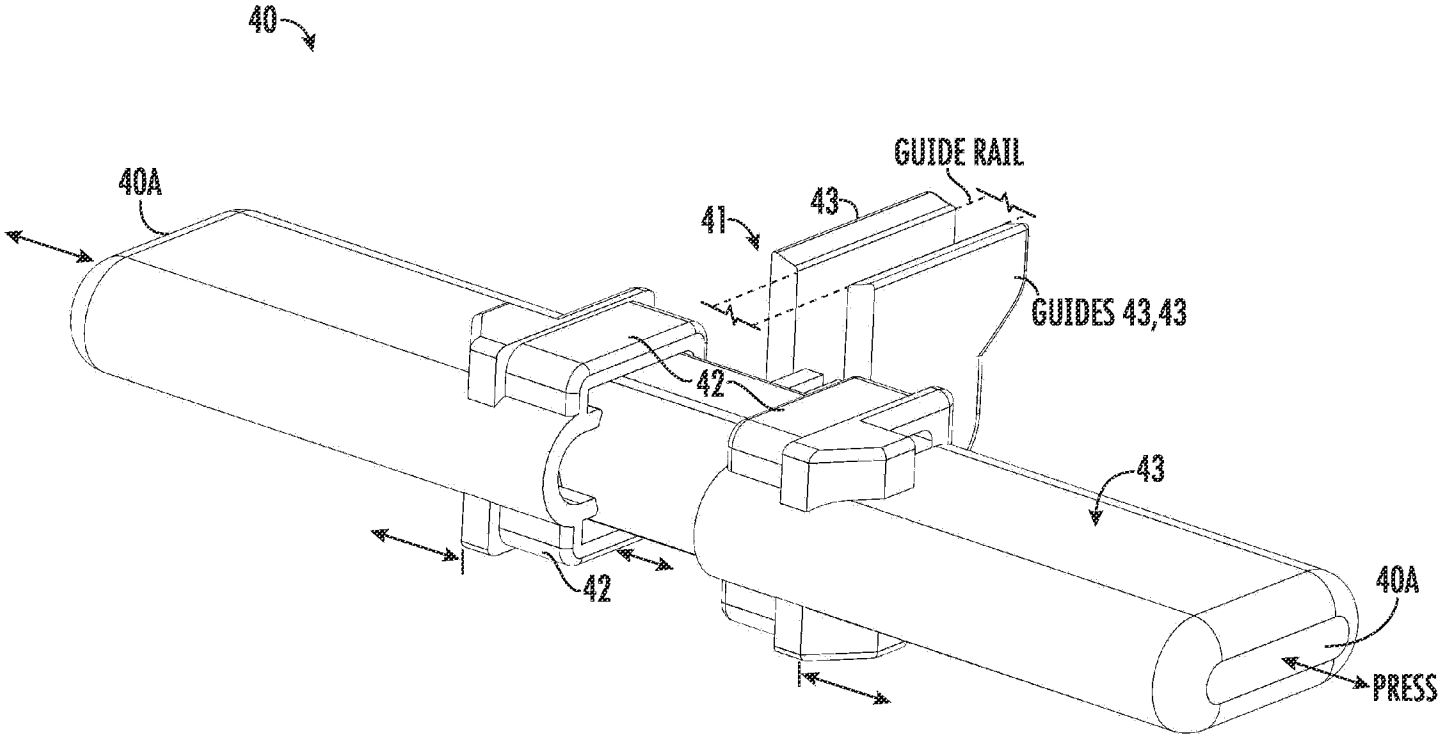
FIG. 9 is a perspective view of a manual dual-sided pressure adjustment safety mechanism.
Figure 10:
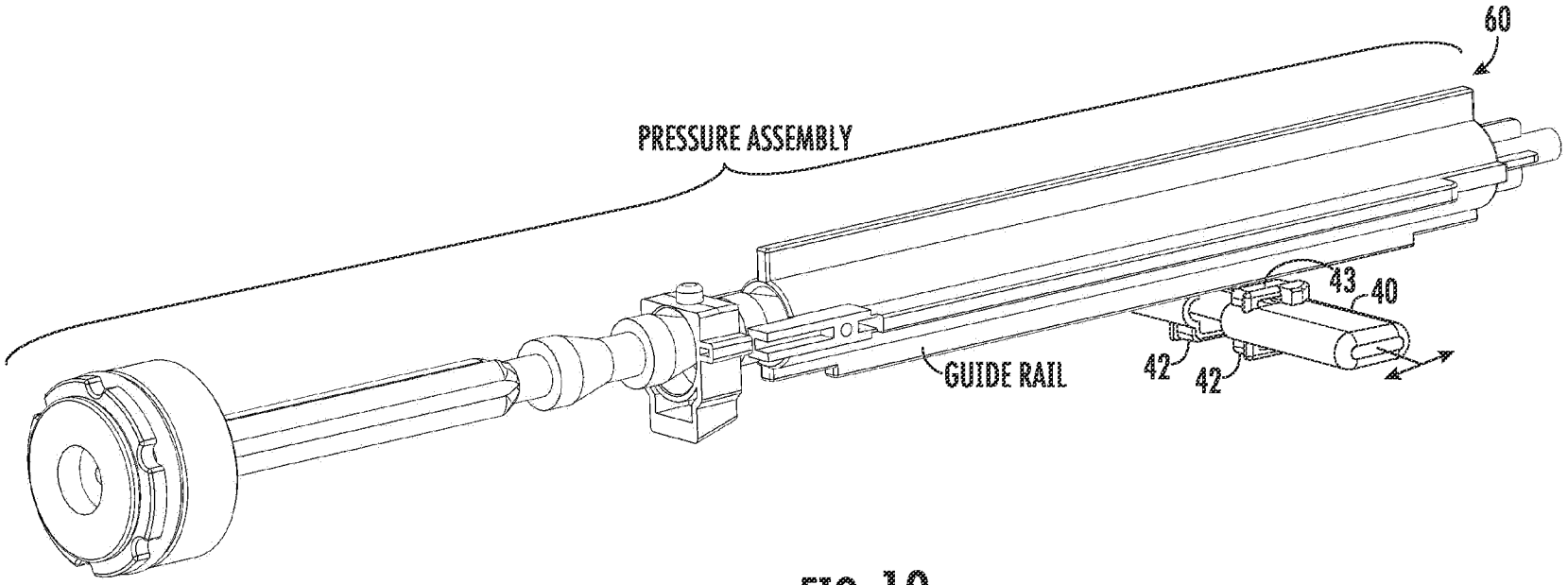
FIG. 10 is a perspective view of a pressure assembly noting relative arrangements.
Figure 11:
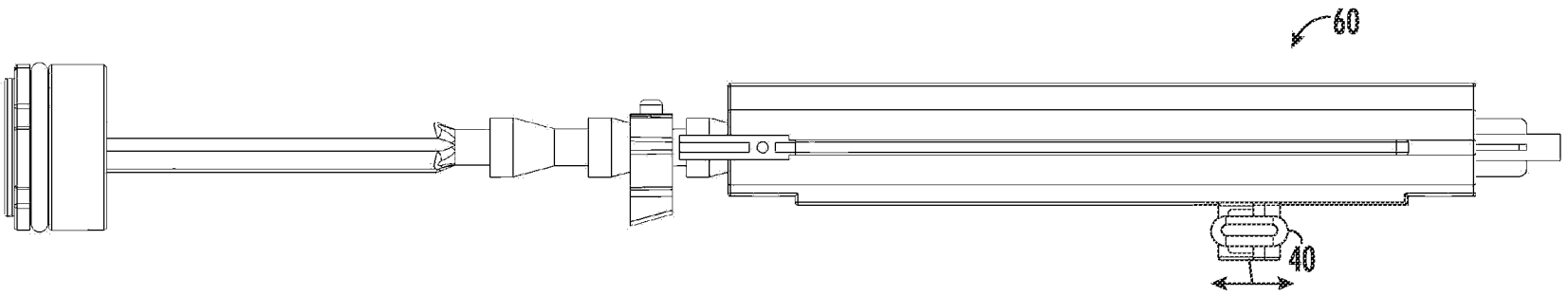
FIG. 11 is a side elevation view of FIG. 10.
Figure 12:
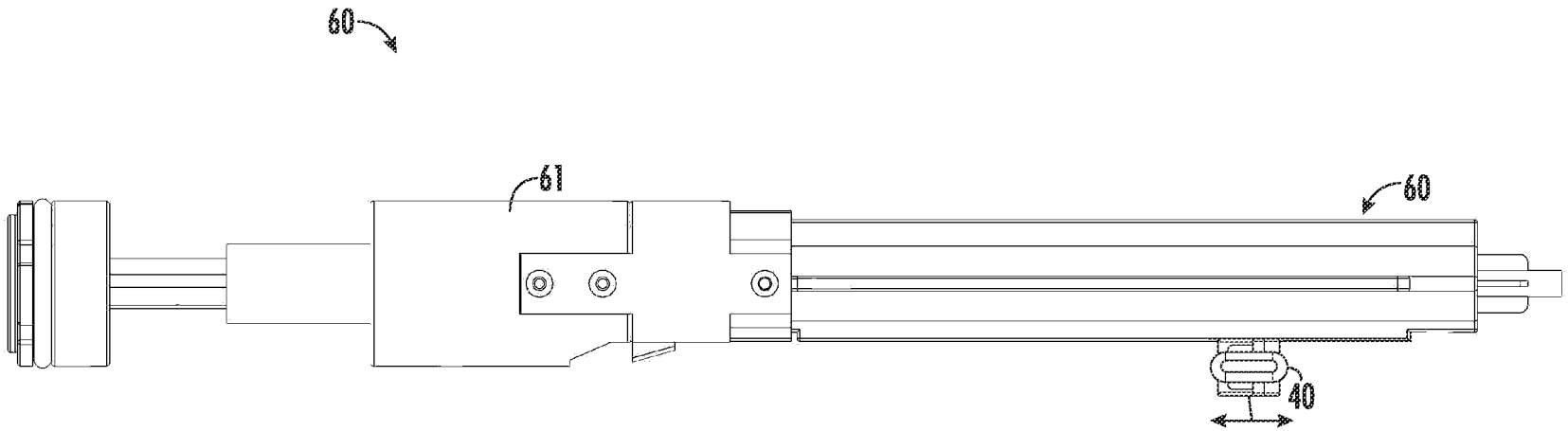
FIG. 12 is a side elevation view similar to FIG. 10 noting the elements and pressure chamber as shown in FIG. 5.

The dual-sided pressure adjustment safety mechanism 40 with the guiding and release mechanism 41 has dual pairs of key blocks 42, 42 on a top and bottom side thereof and related slide guides 43, 43 (FIG. 9). As shown in FIGS. 10-11, slide guides 43, 43 slide along a guiding portion of the pneumatic generation, storage, and release system 60 with pressure generation member 61 so as to ensure a linear motion during a pump motion of pump handle 52.

In this way, those of skill in the art having studied and appreciated the full disclosure herein will recognize the manner in which a variable power adjustment is achieved that provides a variable safety output control system for a pneumatic toy projector. Further, those of skill in the toy arts will appreciate that an adult-pressure application may be within the range of 5 lbs to 25 lbs and at any point and within any range therebetween, whereas juvenile-pressure application may be limited to within 1 lb to 8 lb and at any point and within any range therebetween; thereby recognizing that some overlap may occur based upon the respective strength of the adult/juvenile users. As a result a manufacturer of the proposed invention therein may, by varying spring strength, designate a range of safety suitable for the user and market without departing from the scope of the present invention.

Although only a few embodiments have been disclosed in detail above, other embodiments are possible and the inventors intend these to be encompassed within this specification. The specification describes certain technological solutions to solve the technical problems that are described expressly and inherently in this application. This disclosure describes embodiments, and the claims are intended to cover any modification or alternative or generalization of these embodiments which might be predictable to a person having ordinary skill in the art.

Also, the inventors intend that only those claims which use the words "means for" are intended to be interpreted under 35 USC 112, sixth paragraph. Moreover, no limitations from the specification are intended to be read into any claims, unless those limitations are expressly included in the claims.

Where a specific numerical value is mentioned herein, it should be considered that the value may be increased or decreased by 20%, while still staying within the teachings of the present application, unless some different range is specifically mentioned. Where a specified logical sense is used, the opposite logical sense is also intended to be encompassed.

Having described at least one of the preferred embodiments of the present invention with reference to the accompanying drawings, it will be apparent to those skills that the invention is not limited to those precise embodiments, and that various modifications and variations can be made in the presently disclosed system without departing from the scope or spirit of the invention. Thus, it is intended that the present disclosure covers modifications and variations of this disclosure provided they come within the scope of the appended claims and their equivalents.

What is claimed is:

1. A variable safety output control system (50), for use in a pneumatic toy projector (1) comprising:

a pneumatic pressure generation, storage, and release system (60);

a dart magazine and transfer system (70) operative to store a plurality of darts for sequential dart release and to position respective ones of said darts in a release chamber prior to projection of said dart from said release chamber through a barrel and outwardly from said pneumatic toy projector;

a trigger mechanism (80) operative to engage said pneumatic pressure generation, storage, and release system and release said respective ones of said darts upon an individual trigger mechanism cycle;

a manual dual-sided pressure adjustment safety mechanism (40) engaging with said pneumatic pressure generation, storage and release system to manually adjust a pneumatic power adjustment during a use;

a guiding and release mechanism (41) in said manual dual-sided pressure adjustment safety mechanism;

said guiding and release mechanism operating to guide a pressure generation member (61) during said pneumatic pressure generation; and said guiding and release mechanism having dual pairs of key-blocks (42, 42), operating to adjustably restrain a pneumatic pump power stroke during said use and to restrain said pressure generation member (61).

2. The variable safety output control system, according to claim 1, further comprising:

two opposed spaced-apart pressure portions (40A, 40A) in said dual-sided pressure adjustment safety mechanism (40);

a spring mechanism (43) urging said two opposed spaced-apart pressure portions (40A, 40A) in opposing directions at an adult-strength-pressure level that is substantially greater than a juvenile-strength-level; and said dual pairs of key-blocks (42, 42) on said respective spaced-apart pressure portions (40A, 40A) that operate in conjunction with a motion of said respective spaced-apart pressure portions to manually engage and release one of at least three power safety adjustment stages (51, 51, 51) and fix a length of said pneumatic pump stroke during said use and thereby restrain said pressure generation member (61) accordingly operate said pneumatic toy projector (1) with a variable power via said variable safety output control system (50).

3. The variable safety output control system, according to claim 2, further comprising:

a pump handle (52) in said pneumatic pressure generation, storage and release system (60); and said pump handle (52) operatively directing said pneumatic pump stroke during said use to a limit controlled by said dual-sided pressure adjustment safety mechanism (40).

* * * * *